US006565372B2

(12) United States Patent
Bakker et al.

(10) Patent No.: US 6,565,372 B2
(45) Date of Patent: May 20, 2003

(54) STAGED LOCK FEATURE FOR AN ELECTRICAL CONNECTOR ASSEMBLY HAVING A CAM MATING DEVICE

(75) Inventors: John H. Bakker, Cortland, OH (US); Ronald A. Puhl, Poland, OH (US); Courtney A. Mansky, Youngstown, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/229,576

(22) Filed: Aug. 28, 2002

(65) Prior Publication Data

US 2003/0003787 A1 Jan. 2, 2003

Related U.S. Application Data

(63) Continuation-in-part of application No. 10/159,174, filed on May 31, 2002, which is a continuation-in-part of application No. 09/795,692, filed on Feb. 27, 2001, now Pat. No. 6,422,881.

(51) Int. Cl.[7] ..... H01R 13/62
(52) U.S. Cl. ..... 439/157
(58) Field of Search ..... 439/157, 372, 439/159

(56) References Cited

U.S. PATENT DOCUMENTS 4,145,103 A * 3/1979 Knowles ..... 439/400
5,320,544 A * 6/1994 Naoto et al. ..... 439/157
5,810,612 A 9/1998 Flask et al.
6,439,902 B1 * 8/2002 Cole et al. ..... 439/157

* cited by examiner

*Primary Examiner*—Tulsidas Patel
*Assistant Examiner*—Phuong K Dinh
(74) *Attorney, Agent, or Firm*—Thomas N. Twomey

(57) ABSTRACT

An electrical connector assembly has a first connector with preferably two oppositely protruding cam followers and a second connector having a pivoting cam lever having preferably two lever arms. The two lever arms respectively engage the earn followers when the first connector is initially staged and locked partially into a cavity defined by the second connector, and as the cam lever pivots from an open position and towards a mated position. The first connector, once locked in the staged position within the forward cavity of the second connector, can not be easily or inadvertently withdrawn, thus, proper orientation of the cam followers to the cam lever is assured for initial cam engagement. The assembly is locked in the staged position by the snap fitting of a tab, which projects laterally from the first connector, into a close ended groove carried by a flex wall which is cantilevered from the second connector. Should the first connector be inadvertently pulled backward from the mating direction, a forward facing stop surface of the tab engages, and thereby prevents further withdrawal of the first connector, with a rearward facing lock seat of the flex wall. The stop surface of the tab is disposed substantially perpendicular to the mating direction preventing inadvertent flexing of the flex wall which would otherwise un-lock the first connector from the staged position.

12 Claims, 3 Drawing Sheets

STAGED LOCK FEATURE FOR AN ELECTRICAL CONNECTOR ASSEMBLY HAVING A CAM MATING DEVICE

RELATED PATENT APPLICATION

This is a continuation-in-part application of U.S. patent application Ser. No. 10/159,174, filed May 31, 2002, which is a continuation-in-part of U.S. U.S. Ser. No. 09/795,692, filed Feb. 27, 2001 (U.S. Pat. No. 6,422,881, issued Jul. 23, 2002).

TECHNICAL FIELD

The present invention relates to a staged lock feature for an electrical connector assembly and more particularly to a staged lock feature for an electrical connector assembly having a cam mating device.

BACKGROUND OF THE INVENTION

Known electrical connector systems such as those used with automotive vehicle electrical harnesses typically comprise plastic housings for male and female connectors that fasten together to secure coupling of terminals mounted within the housings. Many male and female connector pairs require a high amount of force to completely engage, resulting in large exertion by the person assembling the connectors together.

To reduce the amount of effort required to assemble connectors while achieving reliable electrical continuity some connectors are provided with cam mating devices. Cam mating devices typically include one or more cam surfaces on an operator handle or lever that is mounted to the housing of one of the connectors to be mated. The other connector housing has one or more protruding cam followers to engage the cam surface(s) so that, as the lever or handle is moved in the desired direction, the cam surface(s) act on the cam follower(s), drawing the connector housings together and forcing secure engagement of the connectors.

One type of cam mating device is a cam lever that transfers rotary motion of the cam lever into linear movement between the connector and a mating connector, facilitating secure engagement of the two connectors and reducing the amount of operator exertion required when making the secure engagement. To operate, the connector having the cam follower must be "staged" or partially inserted into the mating connector to properly orient the cam follower to the cam lever for initial cam engagement. Unfortunately, if the cam follower is not properly aligned to the cam lever, operation of the cam locking feature can result in inadvertent damage to the cam lever or may result in a poorly mated electrical connector assembly.

SUMMARY OF THE INVENTION

An electrical connector assembly has a first connector with preferably two oppositely protruding cam followers and a second connector has a pivoting cam lever having preferably two lever arms. The two lever arms respectively engage the cam followers when the first connector is initially staged and locked partially into a cavity defined by the second connector, and while the cam lever pivots from an open position and towards a mated position. The first connector once locked in the staged position within a forward cavity of the second connector can not be easily or inadvertently withdrawn. Thus, proper orientation of the cam followers to the cam lever is assured for initial cam engagement.

The connectors are locked in staged position by a tab which projects laterally from the first connector and a flex wall which is cantilevered from the second connector and extends forward and parallel to a mating direction of the assembly. During placement of the first connector into the staged position, a preferably ramped rearward facing surface of the tab engages a distal edge of the flex wall causing the flex wall to resiliently flex laterally outward until the tab snaps into a close ended elongated groove which extends along the mating direction. Withdrawal of the first connector from the second connector when in the staged position is prevented via engagement of a forward facing stop surface of the tab with a lock seat of the flex wall which defines the forward closed end of the groove. The stop surface of the tab is disposed substantially perpendicular to the mating direction. Therefore, any inadvertent force placed upon the connectors in a direction opposite to the mating direction will not have a tendency to flex the flex wall laterally outward which would then unwantedly release the flex wall from the tab and thus release the first connector from the staged position.

Advantages of the present invention include a cam lever engaging electrical connector assembly having a locked or non-releasing staged position for reliable engagement of the cam locking or mating feature. Yet other advantages of the present invention are the relatively simple and inexpensive design of the locked staged position feature and its easy incorporation into existing connector assembly designs to reduce the opportunity of cam lever damage during the connector mating process.

BRIEF DESCRIPTION OF THE DRAWINGS

These and other objects, advantages, and features of the present invention will be apparent to those skilled in the vehicle arts upon reading the following description with reference to the accompanying drawings, in which.

DESCRIPTION OF THE PREFERRED EMBODIMENT

Figure 1:
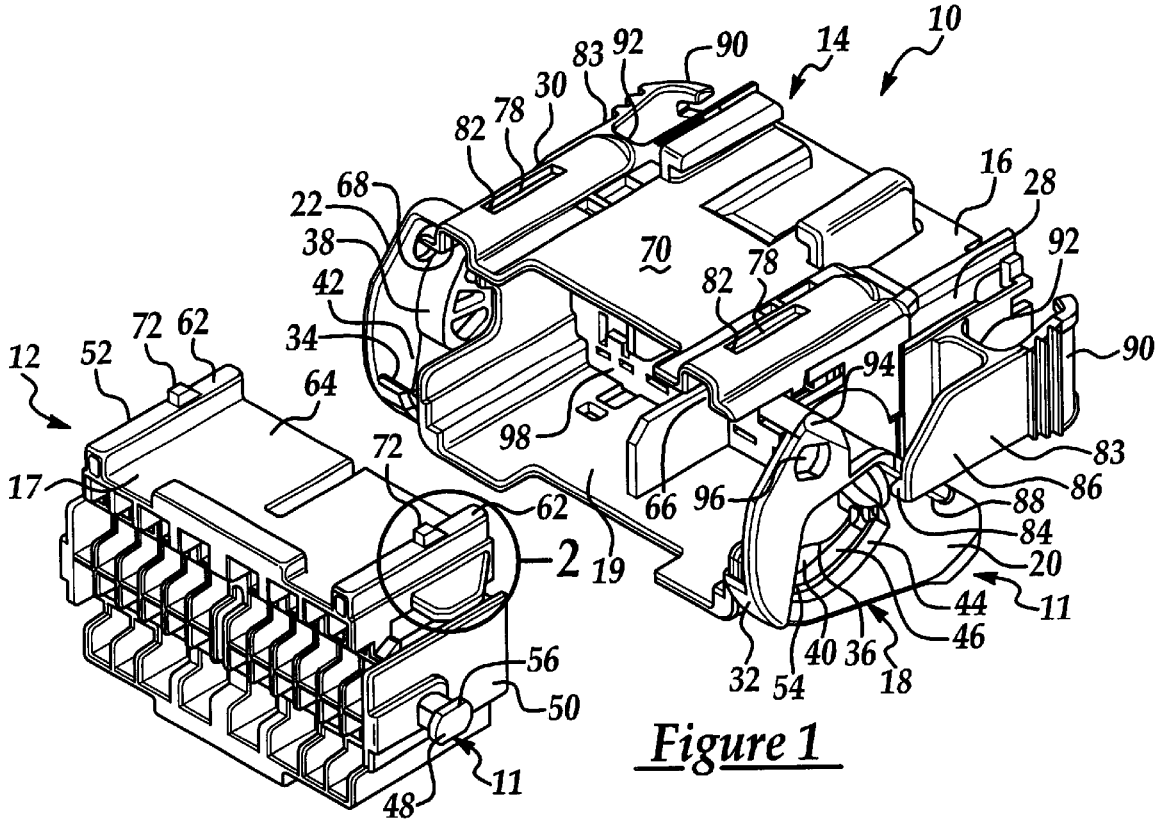
FIG. 1 is an exploded perspective view of an electrical connector assembly in accordance with the present invention.

Referring now to the drawings, FIG. 1 illustrates mating connector assembly 10 utilizing a cam mating device 11. Connectors 12, 14 of the assembly 10 are shown without the terminals or harness wires to avoid cluttering but it will be understood by those skilled in the art that terminals of a known type for terminating harness wires are implemented in the connectors 12, 14 in a known manner. The connector 14 comprises housing 16 and cam lever 18 pivotably mounted thereon. The connector 12 moves along a linear direction to mate into a leading cavity 19 carried by the housing 16 of connector 14. The cam lever 18, the housing 16 of connector 14 and the housing 17 of connector 12 are each preferably integrally molded as single plastic parts.

Figure 3:
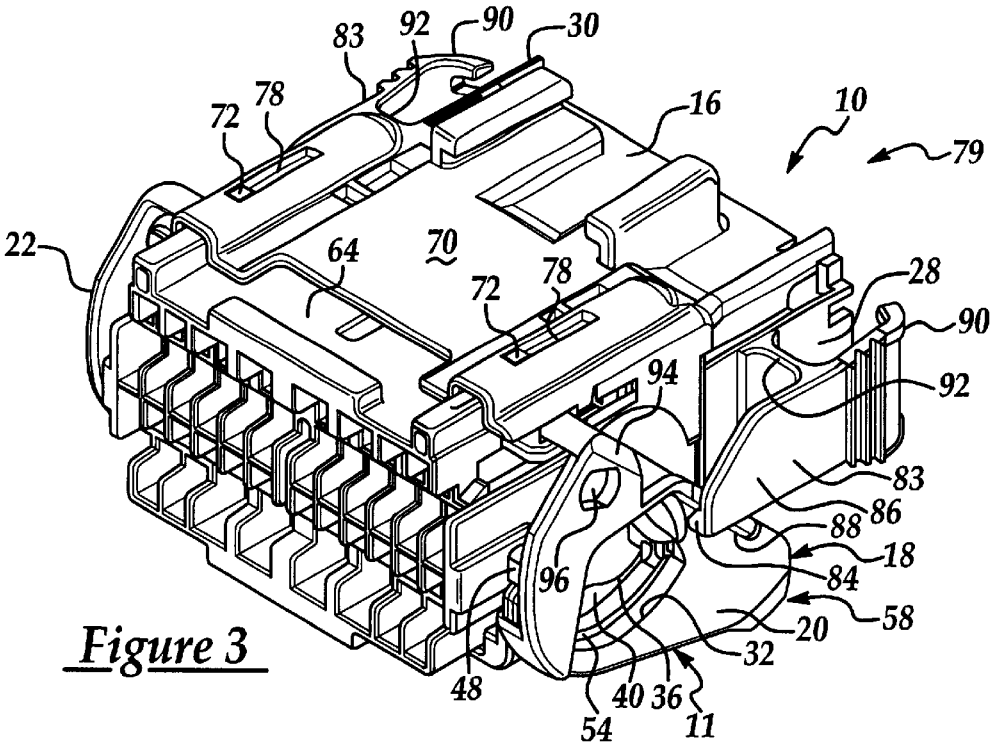
FIG. 3 is a perspective view of the electrical connector assembly shown in a staged position with a cam lever of a cam mating device shown in an open position.
Figure 4:
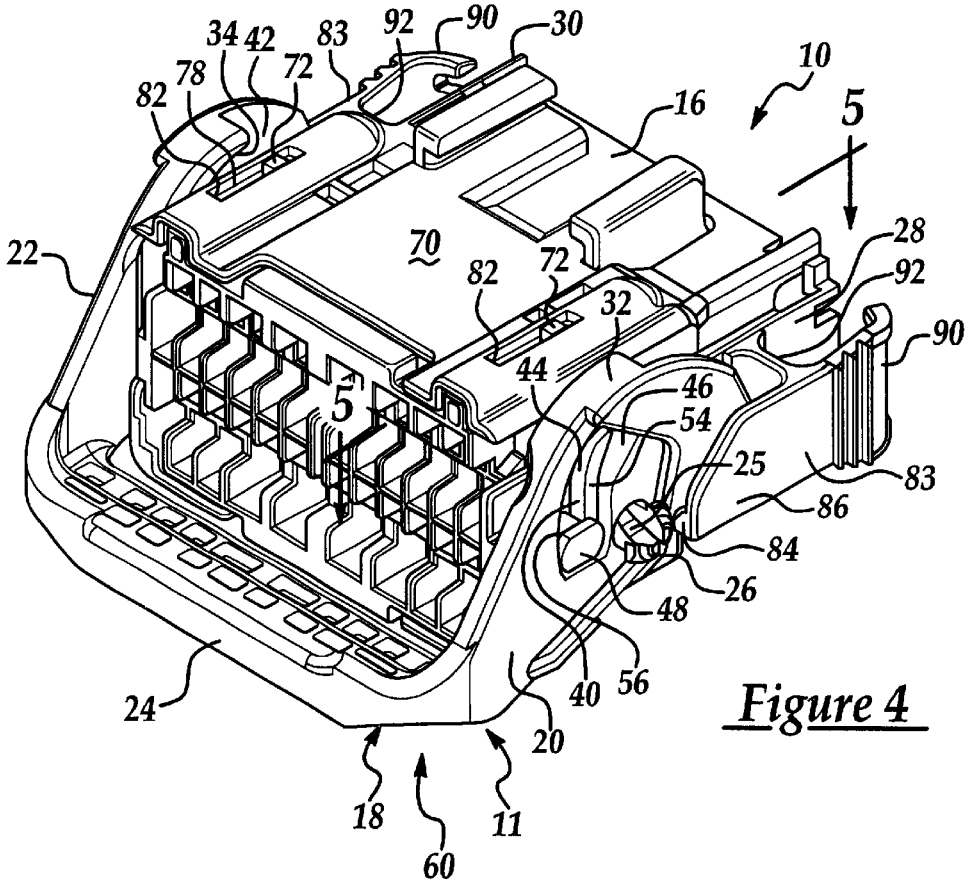
FIG. 4 is a perspective view of the electrical connector assembly shown with the cam lever in a mated position.

Referring to FIGS. 1, 3 and 4, cam lever 18 comprises first and second arms 20, 22 (see FIG. 4) connected at their ends by a handle portion 24, as best shown in FIG. 4. The cam lever 18 includes on each arm 20, 22 a radial surface 25 which defines a circular opening (only one shown) and operates as a bearing surface, riding on a circular cylindrical protrusion 26 (only one shown), one of which extends from a side 28 of the housing 16 and the other of which extends from a side 30 of the housing. The cavity 19 is defined laterally between the two sides 28, 30. Each arm 20, 22 has a lower or outer cam wall 32, 34, respectively, that follows substantially a partial revolution of a spiral, gradually decreasing in radius from opposite the front portions of inner cam walls 36, 38 defining cam pathways 40, 42 which emerge as trailing slots through each respective arm 20, 22.

Referring to FIG. 4, within slot or pathway 40, the inner cam wall 36 deviates into an interior and exterior slot wall 44, 46. Similarly, partially through the cam pathway 42 which leads into the slot 40, the inner wall 36 divides into an interior and an exterior slot wall (not shown). The interior slot walls 44 define the cam pathways 40, 42 for respective cam followers 48 which project from respective first side 50 and opposite second side 52 of connector 12. Vertical walls 54 spanning between the interior slot walls 44 and the exterior or recessed walls 46 form sliding surfaces for the radially projecting end caps or shoulders 56 of the cam followers 48 locking the cam followers 48 within the respective pathways 40, 42, when the cam lever 18 is moved from an open position 58 shown in FIG. 3, to a mated position 60 shown in FIG. 4.

In operation, and prior to moving the lever 18 from the open position 58 to the mated position 60, the housing 17 of connector 12 is first inserted into the cavity 19 of housing 16 of connector 14. During insertion, two longitudinally extending ribs or keys 62 projecting upward from a top surface 64 of the connector 12 slide snugly into and along respective receiving channels 66, 68 carried by a top flex wall 70 which extends laterally between the two sides 28, 30 and in-part defines cavity 19 of the connector 14.

Figure 2:
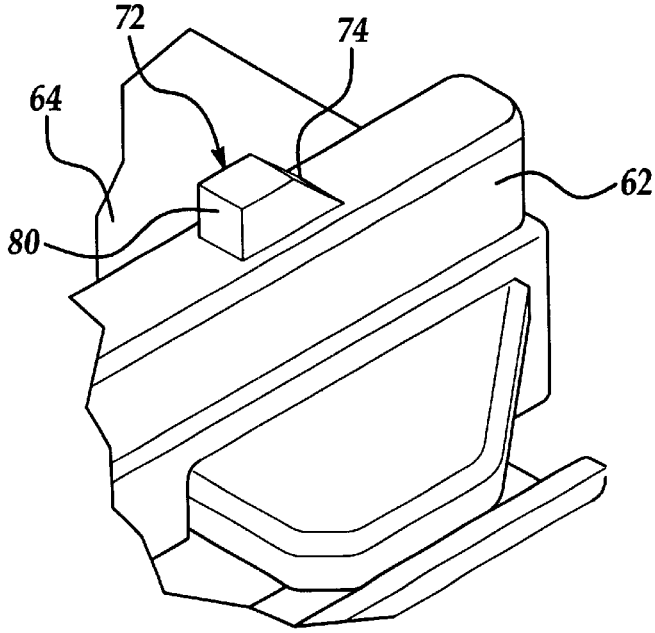
FIG. 2 is an enlarged perspective view of a tab taken from the circle labeled 2 in FIG. 1.

Referring to FIGS. 1 and 2, a locking tab 72 projects upward from an approximate mid-point of each key 62. The locking tab 72 has a leading ramped surface 74 which engages a leading edge of the top flex wall 70 carried at the inverted bottom of the respective channels 66, 68. This engagement, with continued insertion of the connector 12 causes the top flex wall 70 to flex upward permitting ingress of the tabs 72 into the channels 66, 68. Insertion is continued until the tabs 72 snap lock into the forward ends of longitudinally extending close-ended slots or grooves 78, as best shown in FIG. 3.

Each side 28, 30 of housing 16 has leading open ended windows 76 orientated near the top flex wall 70 and channels 66, 68 which cantilevers the top flex wall 70 and thus enable resilient flexing thereof. During insertion of connector 12, the followers 48 enter and traverse the respective windows 76 as the top of the locking tabs 72, slide along the inverted bottom of the channels 66, 68 until the tabs 72 snap lock into the forward ends of the grooves 78, as best shown in FIG. 3.

At this point, the connector 12 is in a locked staged state or position 79 to the connector 14 so that withdrawal of the connector 12 from cavity 19 is prevented by engagement of a stop surface 80 of the tabs 72 to a lock seat 82 carried by the top flex wall 70 and defining the forward ends of the through grooves 78.

The stop surfaces 80 are generally disposed opposite to the ramped surfaces 74 of the tabs 72 and are orientated substantially perpendicular to the respective keys 62. Likewise, the lock seats 82 are substantially disposed perpendicular to the longitude of the through grooves 78 and are substantially parallel to the respective stop surfaces 80 so that the top flex wall 70 is not re-urged outward which would then release the tabs 72 from the through grooves 78 and thus the connector 12 released connector 14. Inadvertent release of the connectors must be prevented, otherwise the followers 48 will become unknowingly misaligned to the cam pathways 40, 42 causing the connector assembly 10 to mate improperly and/or cause damage to the cam lever 18.

The cam lever 18 is locked releasably to the housing 16 of the connector assembly 10 via a pair of flex arms 83 when in both the open position 58 and the mated position 60. When in the open position 58, a locking protrusion 84 which projects inwardly from a forward end or end portion 86 of each flex arm 83 engages a lock seat 88 carried by a rib and which faces and is orientated near the trailing ends of pathways 40, 42. Locking the lever 18 in the open position 58 assures that the lever is aligned properly so that the followers 48 are properly received in the pathways 40, 42 when the connectors 12, 14 are in the staged position 79. To unlock the lever 18 from the open position 58 after the followers 48 are received, ends or end portions 90 of the flex arms 83 are pinched or flexed inwardly toward each other so that the opposite ends 86 carrying the locking protrusions 84 move or pivot outward about flex members 92, engaged between mid-portions of the flex arms 83 and the respective sides 28, 30 of housing 16, and thus clear the lock seats 88.

The lever 18, however, should not be released from the open position 58 until the housing 17 of connector 12 is in the locked staged position 79 to the housing 16 of connector 14, as best shown in FIG. 3. When in position 79, the followers 48 are disposed properly in the receiving ends of pathways 40, 42 so that the lever 18 will then properly operate to mate the connector assembly 10.

When the cam lever 18 is pivoting from the open position 58 to the mating position 60, a second protrusion (not shown) orientated parallel to protrusion 84 rides along a beveled edge or tapered surface 94 carried by the respective arms 20, 22 causing the ends 86 of the flex arms 83 to move outward until the second pair of protrusions snap into lock holes 96 carried by the arms 20, 22, at which point the flex arms 83 pivot or snap back to their natural state and the lever 18 is in the mated position 60.

When the lever achieves the mated position 60 shown in FIG. 4, the connectors 12, 14 are fully mated through the action of the cam pathways 40, 42 on the cam followers 48. Once in the locked mated position 60 the connector assembly 10 can not be un-mated and returned to the staged position 79 unless the ends 90 of the flex arms 83 are pinched or flexed inwardly toward each other releasing the protrusions 84 from the lock holes 96. The mated position 60 also acts as a position assurance in that if the cam lever 18 is fully drawn to the position shown in FIG. 4 and locked in place, it can be assumed that the connectors 12, 14 are fully engaged.

Figure 5:
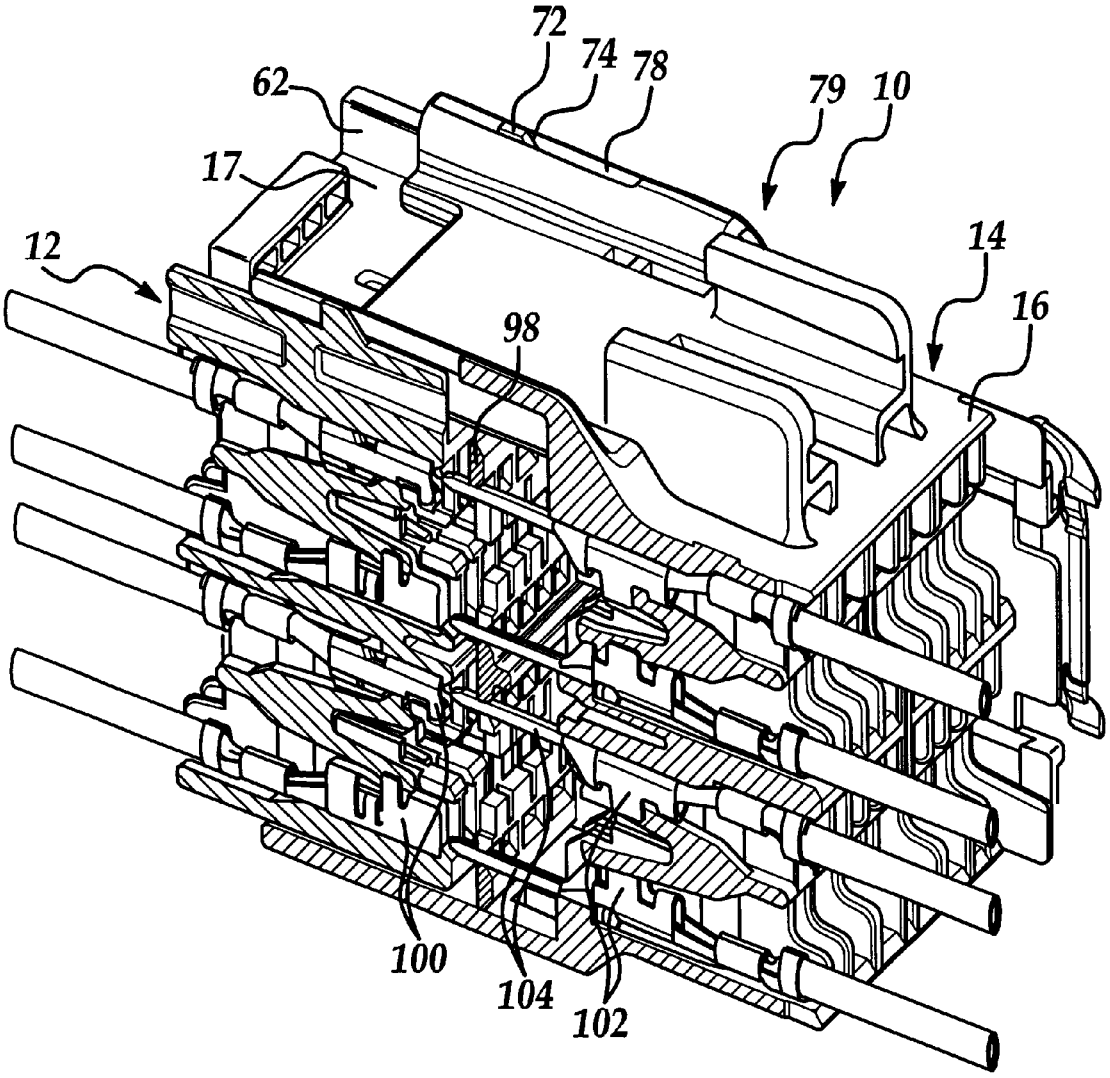
FIG. 5 is a cross section of the electrical connector assembly shown with mating terminals not yet in electrical contact while the assembly is in the staged position.

Referring to FIG. 5, the connector assembly 10 is shown in the staged position 79. A substantially planar stabilizer 98 is disposed between the connectors 12, 14 in a pre-staged position. The structure and operation of stabilizer 98 is further detailed in U.S. Pat. No. 6,422,881, incorporated herein by reference. The housing 17 of the connector 12 supports a series of female terminals 100 and the housing 16 of the connector 14 supports a series of male terminals 102 each having a pin or blade 104 projecting through respective guide apertures 106 of the stabilizer 98, as best shown in FIG. 1. When the assembly 10 is in the staged position 79, the pins 104 are not yet in electrical contact with the female terminals 100 of the connector 14. When the cam lever 18 is released from the locked open position 58 and begins to move or pivot toward the mated position 60, the pins 104 of the male terminals 102 will protrude further through the guide apertures 106 of the stabilizer 98 and thus establishes first or initial electrical contact with the female terminals 102. When the cam lever 18 is in the mated position 60, the pins 104 are fully inserted and engaged to the female terminals 102.

Although the preferred embodiment of the present invention has been disclosed, various changes and modifications may be made by one skilled in the art without departing from the scope and spirit of the invention as set forth in the appended claims. It is also understood that the terms used herein are merely descriptive, rather than limiting, and that various changes may be made without departing from the scope and spirit of the invention.

What is claimed is:

1. An electrical connector assembly comprising:

a connector housing having a flex wall, a cavity being open in a forward mating direction and defined in-part by the flex wall, a rearward facing lock seat, and a groove which is carried by the flex wall, communicates laterally with the cavity, is elongated in the mating direction, and is closed at a forward end by the lock seat;

a cam lever engaged pivotally to the connector housing, the cam lever being constructed to pivot between an open position and a mated position;

a mating connector housing having a staged position, a tab having a forward facing stop surface disposed perpendicular to the mating direction, and a protruding cam follower, wherein the mating connector housing is partially disposed within the cavity when in the staged position, the tab is extended into a forward end of the groove when in the staged position so that contact of the stop surface with the lock seat prevents release of the mating connector from the connector housing, and wherein the cam follower is aligned to engage the cam lever when the mating connector is in the staged position; and wherein rotary movement of the cam lever from the open position to the mated position moves the mating connector from the staged position to fully mate the connector assembly.

2. The electrical connector assembly set forth in claim 1 wherein electrical continuity is not achieved when the mating connector is in the staged position.

3. The electrical connector assembly set forth in claim 2 comprising a stabilizer disposed between the mating connector and the connector housing.

4. The electrical connector assembly set forth in claim 1 wherein withdrawal of the mating connector from the staged position will require appreciable force causing plastic deformation of the tab and the flex wall.

5. The electrical connector assembly set forth in claim 3 wherein mating of the electrical connector assembly is prevented when the mating connector is in the staged position and the cam lever is in the open position via contact of the cam follower with an inner cam wall of the cam lever.

6. The electrical connector assembly set forth in claim 1 wherein the cam lever snap locks to the connector housing when in the open position.

7. The electrical connector assembly set forth in claim 6 wherein the cam lever snap locks to the connector housing when in the mated position.

8. The electrical connector assembly set forth in claim 7 wherein the connector housing has a flex arm having a flex member projecting outward from the connector housing, an end portion cantilevered from the flex member, and at least one locking protrusion projecting transversely from the end portion for snap locking the cam lever in the open and mated positions.

9. The electrical connector assembly set forth in claim 8 wherein the cam lever is disposed between the connector housing and the cantilevered end portion of the flex arm and the locking protrusion projects inward to snap lock to the cam lever.

10. The electrical connector assembly set forth in claim 9 wherein the flex arm has an opposite cantilevered end portion so that manual inward movement of the opposite end portion resiliently flexes the flex member and causes the cantilevered end portion to move outward releasing the protrusion from the cam lever.

11. An electrical connector assembly comprising:

a connector housing having a flex wall, a cavity being open in a forward mating direction and defined in-part by the flex wall, a rearward facing lock seat carried by the flex wall, and a groove being close-ended by the lock seat, wherein the groove is carried by the flex wall, extends in the mating direction and communicates laterally with the cavity;

a mating connector having a staged position, a tab having a forward facing stop surface disposed perpendicular to the mating direction, and a protruding cam follower, wherein the mating connector is partially disposed within the cavity when in the staged position, the tab is extended into a forward end of the groove when in the staged position so that contact of the stop surface with the lock seat prevents release of the mating connector from the connector housing, and wherein the cam followers are aligned to engage a cam lever when the mating connector is in the staged position; and wherein rotary movement of the cam lever from an open position to a mated position moves the mating connector linearly out of the staged position to filly mate the connector assembly.

12. An electrical connector assembly having a cam mating device, the connector assembly comprising:

a connector housing having a flex wall, a cavity being open in a forward mating direction and defined in-part by the flex wall, a rearward facing lock seat, and a groove being close-ended by the lock seat, wherein the groove is carried by the flex wall, extends in the mating direction and communicates laterally with the cavity; and a mating connector having a staged position, a tab having a forward facing stop surface disposed perpendicular to the mating direction, wherein the mating connector is partially disposed within the cavity when in the staged position, the tab is extended into a forward end of the groove when in the staged position so that contact of the stop surface with the lock seat prevents release of the mating connector from the connector housing, and wherein the cam mating device is pre-aligned for initiating mating of the connector assembly.

* * * * *